US006599379B2

(12) United States Patent
Hiskey et al.

(10) Patent No.: US 6,599,379 B2
(45) Date of Patent: Jul. 29, 2003

(54) LOW-SMOKE NITROGUANIDINE AND NITROCELLULOSE BASED PYROTECHNIC COMPOSITIONS

(75) Inventors: Michael A. Hiskey, Los Alamos, NM (US); Darren L. Naud, Los Alamos, NM (US)

(73) Assignee: DMD Systems, LLC, Los Alamos, NM (US)

( * ) Notice: Subject to any disclaimer, the term of this patent is extended or adjusted under 35 U.S.C. 154(b) by 195 days.

(21) Appl. No.: 09/833,874

(22) Filed: Apr. 12, 2001

(65) Prior Publication Data

US 2002/0148540 A1 Oct. 17, 2002

(51) Int. Cl.[7] ..... C06B 45/10; C06B 33/08
(52) U.S. Cl. ..... 149/19.8; 149/38
(58) Field of Search ..... 149/19.8, 38, 49

(56) References Cited

U.S. PATENT DOCUMENTS

| | | | | | |
|---|---|---|---|---|---|
| 3,894,894 | A | * | 7/1975 | Elrick | 149/19.4 |
| 3,901,152 | A | * | 8/1975 | Alexander | 102/37.8 |
| 5,449,423 | A | * | 9/1995 | Cioffe | 149/19.1 |
| 5,520,756 | A | * | 5/1996 | Zeigler | 149/19.8 |
| 5,879,079 | A | * | 3/1999 | Hohmann et al. | 366/151.1 |
| 5,917,146 | A | * | 6/1999 | Hiskey et al. | 149/36 |
| 6,197,135 | B1 | * | 3/2001 | Monte et al. | 149/19.2 |
| 6,206,988 | B1 | * | 3/2001 | Bazaki | 149/19.6 |

FOREIGN PATENT DOCUMENTS

DE 2746809 * 5/1978

* cited by examiner

*Primary Examiner*—John Hardee
(74) *Attorney, Agent, or Firm*—James C. Kennedy, III, Esq.

(57) ABSTRACT

A low-smoke pyrotechnic composition comprising nitrocellulose; nitroguanidine; an oxidizing agent; and, at least one of a flame coloring agent and metal powder, and a method of processing the same is disclosed.

26 Claims, No Drawings

LOW-SMOKE NITROGUANIDINE AND NITROCELLULOSE BASED PYROTECHNIC COMPOSITIONS

FIELD OF THE INVENTION

The present invention relates to pyrotechnic compositions and more particularly to low-smoke producing pyrotechnic compositions.

BACKGROUND OF THE INVENTION

Amusement parks often employ pyrotechnic compositions in the form of colorful fireworks. Unfortunately, the burning of large quantities of such pyrotechnics can generate large amounts of smoke and depending upon the particular weather conditions, such as wind direction, wind speed and relative humidity, the smoke can block the view of additional fireworks or can envelop the audiences leading to possible undesirable health effects. Other venues with inherently little ventilation, such as sports arenas, theatrical and music stages, are greatly limited by the size and quantity of pyrotechnics that can be displayed.

The number and types of pyrotechnic devices for entertainment purposes are numerous, but most generally consist of flammable compositions that burn to produce colored flames or to provide some type of propulsion. Some examples are lances, which produce a colored flame only and are typically used in large sets or arrays to produce figures (e.g. flags) or letters or words. Other devices known to the pyrotechnics industry are "flares," which produce an effect comparable to lances, but are generally larger in size. The devices called "waterfalls" burn with or without colored flames and generate a large cascade of burning metal sparks. The devices called "gerbs" (also known as fountains) utilize pyrotechnic compositions to vertically propel burning metal sparks and in addition produce a colored flame. Color-producing pellets, referred to as "stars," are employed in "shells" or "roman candles" or "star mines" and often contain stars in multiple amounts. Typically black powder is used to ignite and propel the stars out of such devices.

Among typical compositions for a red and white lance have been: (1) potassium chlorate, strontium nitrate, sulfur, charcoal and shellac; and (2) potassium nitrate, antimony sulfide, antimony metal and sulfur.

Among typical compositions for gerbs or fountains have been: (1) potassium nitrate, charcoal, sulfur, steel powder; or (2) potassium nitrate, strontium nitrate, potassium benzoate and titanium metal powder.

Among typical compositions for a red star have been: (1) potassium chlorate, strontium carbonate, charcoal, red gum (or shellac), and dextrin (or rice starch); (2) potassium perchlorate, strontium perchlorate, charcoal, red gum (or shellac), dextrin (or rice starch) and polyvinyl chloride (PVC); or (3) strontium nitrate, red gum (or shellac), magnalium (an alloy of magnesium and aluminum) and PARLON® chlorinated rubber $(C_6H_6Cl_4)_n$.

Undesirably, in part due to the relatively large quantities of metal compounds required in such typical compositions, relatively large quantities of smoke and ash are produced with potentially undesirable environmental consequences.

It therefore an object of this invention to provide a low-smoke producing pyrotechnic composition comprising nitroguanidine, nitrocellulose, an oxidizing agent, and at least one of a flame coloring agent and a metal powder. Another object of the invention is to provide a low-smoke producing pyrotechnic composition wherein the flame coloring agent is a metal salt. It is yet another object of the invention to provide a method for processing a low-smoke producing pyrotechnic composition.

SUMMARY OF THE INVENTION

To achieve the foregoing and other objects, and in accordance with the purposes of the present invention, as embodied and broadly described herein, the present invention provides a low-smoke producing pyrotechnic composition for producing one of a colored flame and spark producing pyrotechnic display and method for processing the same.

In a first embodiment, the pyrotechnic composition includes nitrocellulose fuel; nitroguanidine fuel; an oxidizing agent; and, at least one of a flame coloring agent and spark producing metal powder.

In one embodiment, the pyrotechnic composition includes The pyrotechnic composition wherein the nitrocellulose is from about 13 to about 97 percent by weight, the nitroguanidine is from about 1 to about 70 percent by weight, the oxidizing agent is from about 1 to about 68 percent by weight, and the at least one of a flame coloring agent and spark producing metal powder is from about 1 to about 20 percent by weight.

In another embodiment, the pyrotechnic composition includes nitrocellulose from about 22 to about 97 percent by weight.

In another embodiment, the method includes providing nitrocellulose fuel from about 13 to about 97 percent by weight; adding nitroguanidine fuel from about 1 to about 70 percent by weight; adding an oxidizing agent from about 1 to about 68 percent by weight; adding at least one of a flame coloring agent and a metal powder from about 1 to about 20 percent by weight; and, mixing the low-smoke producing pyrotechnic composition.

In related embodiments, the method includes adding a water-soluble binder prior to the step of mixing; and further, forming a geometrical shape from the pyrotechnic composition; and, air-drying said geometrical shape wherein the geometrical shape includes the forming of right cylinders, and hollow core cylinders. Yet further, the method includes igniting the hollow core cylinders at the longitudinal ends of said hollow core cylinders.

DETAILED DESCRIPTION

The present invention is concerned with pyrotechnic compositions also commonly known to as fireworks compositions. The pyrotechnic compositions of the present inventions are characterized as low-smoke compositions.

The pyrotechnic compositions of the present invention include nitrocellulose as a principal component by weight. Nitrocellulose is a fast burning, easily ignitable, energetic material and has been used in such applications as explosives, gun and rocket propellants. Optimally, in the present invention, the nitrocellulose may have at least 12 percent by weight nitrogen. In addition to nitrocellulose, the pyrotechnic compositions of the present invention include nitroguanidine, a clean-burning energetic material that has the property of modifying the burn rate of nitrocellulose.

In addition to the nitrocellulose and nitroguanidine fuels, the pyrotechnic compositions of the present invention include an oxidizing agent that may comprise a mixture of oxidizing agents. Suitable oxidizing agents can generally include ammonium perchlorate, alkali metal perchlorates such as potassium perchlorate and the like, and alkali metal nitrates such as potassium nitrate and the like. Alkali chlorates may be employed as oxidizing agents but are generally not preferred due to sensitivity problems. Ammonium perchlorate is a preferred oxidizer as the absence of any metal ions eliminates ash residue. Ammonium perchlorate has the added benefit of providing a source of chlorine to the pyrotechnic composition, as it is generally known that a good quality pyrotechnic flame requires a source of chloride ions. A mixture of oxidizing agents such as ammonium perchlorate and potassium perchlorate has been used with success, and reduces the production of noxious hydrogen chloride gas as a combustion by-product. The burning of ammonium perchlorate and fuel produces hydrogen chloride, while the burning of potassium perchlorate with fuel produces potassium chloride, which is benign.

In addition to the nitrocellulose and nitroguanidine fuels and oxidizing agent, various metal salts can be advantageously employed as flame coloring agents (flame colorants). Those skilled in the art recognize that each metal of the periodic table has well known spectra associated with the burning of such metals. Among the metal salts that may be advantageously employed are calcium salts such as calcium carbonate for the color red-orange, strontium salts such as strontium nitrate for the color red, barium salts such as barium nitrate for the color green, boron compounds for the color green, sodium salts such as sodium nitrate for the color orange-yellow, copper salts such as copper chloride for the color blue, potassium salts such as potassium chloride for the color violet, and the antimony salts such as antimony sulfide for the color white. Furthermore, combinations of metal salts can yield other desirable colors. For example, a combination of copper sulfide and strontium nitrate has a red-purple color, and a combination of copper sulfide and barium nitrate has a blue-green color, and a combination of barium nitrate and sodium nitrate has a yellow color. In spite of their toxicities, other metal salts such as cadmium, uranium, gold, mercury, arsenic and lead may be used to provide other colors if desired. Carbonate salts are generally preferred over salts such as chloride salts as the chloride salts tend to be hydrates and contribute undesired water. The flame colorant of the present invention requires smaller amounts of flame colorant compared to traditional formulations and is generally added in amounts of from about 1 percent by weight to about 20 percent by weight, preferably from about 5 percent by weight to about 10 percent by weight based on total weight of fuel, oxidant and flame colorant. In addition, carbonate salts act as a stabilizer for nitrocellulose as they neutralize any acid generated by the decomposition of nitrocellulose.

While not wishing to be bound by the present explanation, it is believed that the burn rate, purity, and size of the flame envelope are among the important properties of pyrotechnic compositions. It has been found that test mixtures of nitrocellulose, oxidant and metal colorant in a variety of proportions produce poor flame colors. This is attributed to the impurities that are found in nitrocellulose, such as sodium salts, that when burned produce yellow-orange light and degrade the desired colors. Likewise, mixtures of nitroguanidine, oxidant and metal flame colorant in a variety of proportions or pure nitroguanidine burn at very slow rates or cannot sustain a flame. However, it has been found according to the present invention, that a mixture of nitrocellulose and nitroguanidine in the appropriate proportions, together with an oxidizing agent and flame colorant burn smoothly and with a large, brightly colored flame envelope, requiring relatively less flame colorant and with little production of smoke. The size of the flame envelope is an important feature of a burning pyrotechnic composition. A large, colored flame envelope from a burning star increases the visibility of the display to the audience while requiring a smaller amount of composition.

Chlorine can be added to the compositions by addition of a metal chloride salt as the flame colorant or by use of ammonium perchlorate as the oxidizer. Use of ammonium perchlorate as the oxidizer or as part of a mixture of oxidizers is generally preferred to supply the chloride ions.

Metal flakes or powder can be added to the compositions to increase the temperature or light output of the flame or to produce a spark effect. Suitable metals can include aluminum, magnesium, titanium and iron or their alloys such as magnesium/aluminum or steel. Iron powder can be generally substituted with steel powder to avoid rusting from moisture.

The pyrotechnic composition of the present invention can be used to form stars that are arranged into a typical fireworks shell construction or as a typical roman candle construction. Such common constructions generally include a multiple of stars formed of the pyrotechnic compositions of the present invention together with appropriate amounts of black powder, bursting charge, any propulsion agent and any necessary delay fusing.

In addition, the pyrotechnic composition of the present invention can be used as the propulsion agents in gerbs, fountains or lances with colored flames.

The present invention is more particularly described in the following examples, which are intended as illustrative only, as numerous modifications and variation will be readily apparent to those skilled in the art.

EXAMPLES

Example 1

A star composition was formulated by processing a damp mixture of 55.5 grams wet nitrocellulose (containing 30 weight percent water), 18 grams nitroguanidine, 18 grams ammonium perchlorate, 5 grams of 20 weight percent aqueous solution of polyvinyl alcohol and 8 grams metal salt colorant in a high speed cutter-mixer. The metal salts typically used to produce red, orange, green, orange-yellow and blue flame colors were respectively strontium carbonate, calcium carbonate, barium carbonate and basic copper carbonate. The color purple is produced from a mixture of strontium carbonate and basic copper carbonate salts; and yellow color is produced from a mixture of barium carbonate and calcium carbonate salts. The composition was then pressed into right-cylindrical pellets with a dimension of 0.25 inches tall and 0.25 inches diameter and air-dried to form strong, easily ignitable stars.

Example 2

A red flare composition was formulated by processing a damp mixture of 58 grams wet nitrocellulose (containing 30 weight percent water), 7.8 grams nitroguanidine, 21.4 grams ammonium perchlorate, 7.8 grams strontium carbonate, 3.9 grams titanium metal powder and 8 grams of 20 weight percent aqueous solution of polyvinyl alcohol in a high speed cutter-mixer. The pyrotechnic mixture is pressed into cardboard tubes and air-dried. Using the same procedure, a blue flare composition was formulated with 28 grams wet nitrocellulose (containing 30 weight percent water), 38.6 grams nitroguanidine, 21.1 grams ammonium perchlorate, 7.7 grams basic copper carbonate, 3.9 grams titanium metal powder and 8 grams of 20 weight percent aqueous solution of polyvinyl alcohol.

Example 3

The following compositions are suitable for gerb devices that burn slowly. For an orange gerb formulation, a damp mixture of 29 grams wet nitrocellulose (containing 30 weight percent water), 48 grams nitroguanidine, 12.5 grams ammonium perchlorate, 4.1 grams calcium carbonate, 6 grams titanium metal powder and 5 grams of 20 weight percent aqueous solution of polyvinyl alcohol was processed in a high speed cutter-mixer. A blue gerb formulation consisted of 18 grams wet nitrocellulose (containing 30 weight percent water), 54.5 grams nitroguanidine, 12 grams ammonium perchlorate, 8.1 grams basic copper carbonate, 6 grams titanium metal powder and 5 grams of 20 weight percent aqueous solution of polyvinyl alcohol.

Example 4

The following compositions are suitable for gerb devices that burn faster than those compositions described in Example 3. For a purple gerb formulation, a damp mixture of 48 grams wet nitrocellulose (containing 30 weight percent water), 25 grams nitroguanidine, 12.5 grams ammonnium perchlorate, 3.3 gram basic copper carbonate, 5 grams strontium carbonate, 6.5 grams titanium metal powder and 6 grams of 20 weight percent aqueous solution of polyvinyl alcohol was processed in a high speed cutter-mixer. A green formulation consisted of 45.5 grams wet nitrocellulose (containing 30 weight percent water), 24 grams nitroguanidine, 16 grams ammonium perchlorate, 8 grams barium carbonate, 6 grams titanium metal powder and 5 grams of 20 weight percent aqueous solution of polyvinyl alcohol.

Example 5

A silver-colored gerb device that burns at relatively slow rate and contains only potassium perchlorate as the oxidant was formulated by processing a damp mixture of 31 grams wet nitrocellulose (containing 30 weight percent water), 50 grams nitroguanidine, 8.9 grams potassium perchlorate, 5.5 grams titanium metal powder and 5 grams of 20 weight percent aqueous solution of polyvinyl alcohol in a high speed cutter-mixer.

Example 6

A yellow colored gerb device that burns at relatively slow rate and contains a mixture of ammonium perchlorate and potassium perchlorate as the oxidant was formulated by processing a damp mixture of 31 grams wet nitrocellulose (containing 30 weight percent water), 42.5 grams nitroguanidine, 6.3 grams potassium perchlorate, 3.9 grams ammonium perchlorate, 5.8 grams barium carbonate, 0.4 grams calcium carbonate, 5.5 grams titanium metal powder and 5 grams of 20 weight percent aqueous solution of polyvinyl alcohol in a high speed cutter-mixer.

What is claimed is:

1. A low-smoke producing pyrotechnic composition for producing one of a colored flame and spark producing pyrotechnic display comprising:

nitrocellulose fuel from about 13 to about 97 percent by weight;

nitroguanidine fuel from about 1 to about 70 percent by weight;

an oxidizing agent from about 1 to about 68 percent by weight; and, at least one of a flame coloring agent and spark producing metal powder each from about 1 to about 20 percent by weight.

2. The pyrotechnic composition of claim 1 wherein the flame coloring agent comprises at least one metal salt.

3. The pyrotechnic composition of claim 2 wherein the at least one metal salt includes a metal selected from the group consisting of barium, strontium, iron, copper, boron, calcium, antimony, potassium, sodium, cadmium, uranium, gold, mercury, arsenic, and lead.

4. The pyrotechnic composition of claim 2 wherein the at least one metal salt comprises a carbonate salt.

5. The pyrotechnic composition of claim 2 wherein the oxidizing agent includes at least one compound selected from the group consisting of ammonium perchlorate, alkali metal perchlorates, alkali metal chlorates, and alkali metal nitrates.

6. The pyrotechnic composition of claim 1 wherein the oxidizing agent includes at least one compound selected from the group consisting of ammonium perchlorate, alkali metal perchlorates, alkali metal chlorates, and alkali metal nitrates.

7. The pyrotechnic composition of claim 1 wherein the metal powder includes at least one compound selected from the group consisting of titanium and titanium alloys.

8. The pyrotechnic composition of claim 1 wherein the metal powder includes at least one compound selected from the group consisting of iron and alloys of iron.

9. The pyrotechnic composition of claim 1 wherein the metal powder includes at least one compound selected from the group consisting of magnesium and alloys of magnesium.

10. The pyrotechnic composition of claim 1 wherein the metal powder includes at least one compound selected from the group consisting of aluminum and alloys of aluminum.

11. The pyrotechic composition of claim 1 wherein the nitrocelllulose fuel is from about 22 to about 97 percent by weight, the nitroguanidine fuel is from about 1 to about 70 percent by weight, the oxidizing agent is from about 1 to about 68 percent by weight, and the at least one of a flame coloring agent and spark producing metal powder each is from about 1 to about 20 percent by weight.

12. The pyrotechnic composition of claim 1 further comprising a binder.

13. The pyrotechnic composition of claim 12 wherein the binder comprises a water soluble binder.

14. The pyrotechnic composition of claim 1 further including black powder, bursting charge, propulsion agents and delay fusing.

15. A method of processing a low-smoke producing pyrotechnic composition comprising:

providing damp nitrocellulose fuel from about 13 to about 97 percent by weight;

adding nitroguanidine fuel from about 1 to about 70 percent by weight;

adding an oxidizing agent from about 1 to about 68 percent by weight;

adding at least one of a flame coloring agent and a metal powder each from about 1 to about 20 percent by weight; and, mixing the low-smoke producing pyrotechnic composition.

16. The method of claim 15 wherein the damp nitrocellulose comprises about 30 percent by weight of water.

17. The method of claim 15 wherein a water-soluble binder is added prior to the step of mixing.

18. The method of claim 17 wherein the water-soluble binder is polyvinyl alcohol.

19. The method of claim 14 further comprising:

forming a geometrical shape from the pyrotechnic composition; and, air-drying said geometrical shape.

20. The method of claim 19 wherein the step of forming a geometrical shape includes the forming of right cylinders, and hollow core cylinders.

21. The method of claim 20 further comprising igniting the hollow core cylinders at the longitudinal ends of said hollow core cylinders.

22. The method of claim 15 wherein the damp nitrocellulose fuel is added from about 22 to about 97 percent by weight.

23. The method of claim 15, further comprising the step of forming pyrotechnic devices selected from the group consisting of flares, gerbs, fountains, lances, and stars.

24. The method claim 23, wherein the stars comprise multiple stars arranged in one of a shell construction and Roman candle construction further comprising at least one of black powder, bursting charge, propulsion agents, and delay fusing.

25. A method of processing a low-smoke producing pyrotechnic composition comprising:

providing nitrocellulose from about 30 to about 97 percent by weight;

adding nitroguanidine from about 1 to about 70 percent by weight;

adding an oxidizing agent from about 1 to about 68 percent by weight;

adding at least one of a flame coloring agent and a metal powder from about 1 to about 20 percent by weight; and, mixing the low-smoke producing pyrotechnic composition.

26. The method of claim 25, wherein the step of providing nitrocellulose includes providing damp nitrocellulose.

* * * * *